United States Patent [19]

Ergaver et al.

[11] 4,292,986

[45] Oct. 6, 1981

[54] ELECTRIC HAIR BRUSH

[75] Inventors: Nevenka Ergaver; Rayko Ergaver, both of Toronto, Canada

[73] Assignee: Capella Inc., Freeport, The Bahamas

[21] Appl. No.: 770,549

[22] Filed: Feb. 22, 1977

[30] Foreign Application Priority Data

Feb. 2, 1977 [CA] Canada ..... 270926

[51] Int. Cl.[3] ..... A45D 24/00

[52] U.S. Cl. ..... 132/11 R

[58] Field of Search ..... 132/11 R, 121-122, 132/33, 40, 9, 34, 36, 37 R; 219/225, 222

[56] References Cited

U.S. PATENT DOCUMENTS

| | | | |
|---|---|---|---|
| 1,033,122 | 7/1912 | Schwartz | 219/225 |
| 1,095,392 | 5/1914 | Frey | 132/37 R |
| 3,257,541 | 6/1966 | Jorgensen | 132/33 R |
| 3,487,197 | 12/1969 | D'Elia et al. | 132/33 R |
| 3,534,392 | 10/1970 | Trouilhet | 132/37 R |
| 3,705,974 | 12/1972 | Nilsson | 132/33 R |
| 3,814,113 | 6/1974 | Morane | 132/36 R |
| 3,961,635 | 6/1976 | Miya | 132/11 R |

*Primary Examiner*—G. E. McNeill

*Attorney, Agent, or Firm*—Lawrence I. Field

[57] ABSTRACT

A hair styling brush consisting of a handle and a heating element, and an open ended tube having a number of rows of radially projecting teeth extending from its outer surface, each tooth having a substantially rectangular cross section and having a length from base to apex of from $\frac{1}{4}''$ to $\frac{3}{8}''$.

6 Claims, 4 Drawing Figures

ELECTRIC HAIR BRUSH

This invention relates to an electric hair styling brush.

At the present time, there are numerous types of styling appliances for use in hair-dressing. One well-known appliance is an electrically heated curling iron upon which hair is placed, nipped by a clip, and then curled around the iron by rotating the iron on its longitudinal axis. This type of curling iron needs skill to operate properly as it is necessary to grasp every stray piece of hair in the clip before curling, which is a relatively awkward procedure for a person styling their own hair. The use of an excessive amount of heat is also quite common and liable to cause "split ends" in most hair. There is also a possibility that the scalp can be scorched when the curling iron is wound tightly in that hair, so bringing the iron in very close proximity to the scalp.

Another type of hair styler uses a set of heat hair curlers which, after heating, are rolled in the hair and left in place for a required time to set the hair.

Both of the above types of prior art styling items do not provide a finished style in that, after using a curling iron or heated hair curler, it is necessary to wait for five to ten minutes before the hair can be brushed out into the finished style.

It is known to use a styling brush which is of a cylindrical form with which the hair is merely brushed, and to even use a cylindrical form of hair brush which can be attached to a hair dryer so that warm air can be blown around the brush, and the hair can therefore be warmed to help styling. With these known types there are the respective problems of no heat and not enough available heat for styling dry hair, the main use of the latter item being for use in drying hair after washing.

The hair styling brush of this invention, consists generally of a hollow cylindrical tube which is provided with rows of radially extending teeth, the tube and teeth being made of a heat conducting material. The tube is placed over the heating element of a standard hair curling iron and so can be heated for styling purposes.

The invention will now be described with reference to the attached drawings in which.

Figure 1:
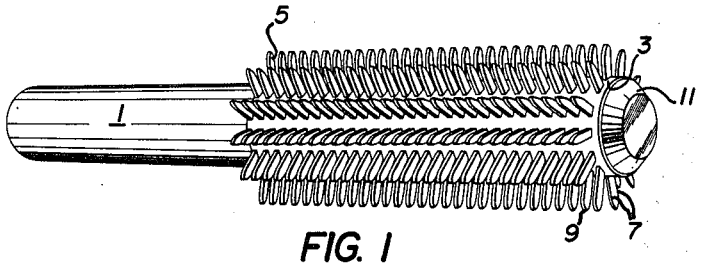
FIG. 1 is a perspective view of an embodiment of the hair brush.

Referring now to the drawings, the hair brush consists of a cylindrical tube 1 having a thickened wall portion 3 upon which, are formed, by extrusion and machining, a plurality of rows of teeth 5. The teeth are of a rectangular cross-section and have substantially parallel narrow edges 7 ending in a rounded point 9. A cap 11 is fitted into the end of the tube, this cap preferably being of non heat-conductive material to prevent inadvertent burning of the scalp during use. The tube 1 is slid over a standard hair curling iron heating element (not shown) and is secured to the handle of the curling iron by means of scews or the like (not shown).

Figure 2:
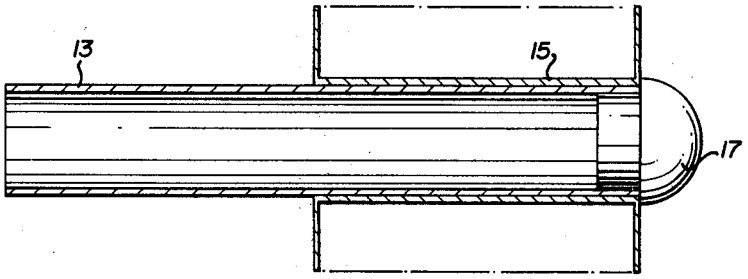
FIG. 2 is a cross-sectional view of a second embodiment of the hair brush of FIG. 1.

Referring to FIG. 2, there is shown a second embodiment of the invention having a hollow tube 13 and a separate tube 15 having the teeth formed thereon by extrusion and machining, tube 15 being a friction fit on tube 13. An cap 17 is utilized in a similar manner to cap 11 in FIG. 1 and can also be used, if required, to hold tube 15 in place on tube 13.

Figure 3:
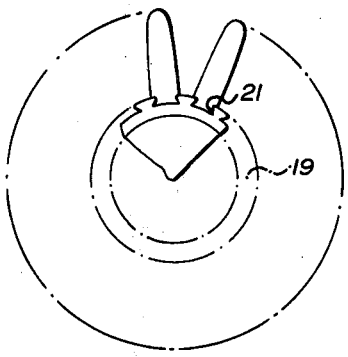
FIG. 3 is an end view of a third embodiment of hair brush.
Figure 4:
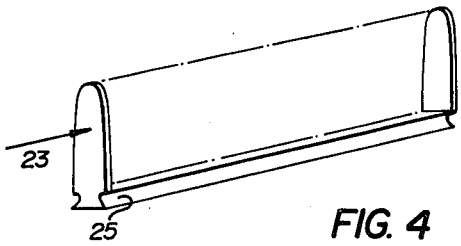
FIG. 4 is a perspective view of a row of teeth as used in the embodiment of FIG. 3.

A third embodiment of the hair brush is shown in FIGS. 3 and 4 wherein a tube 19 similar to tube 1 in FIG. 1 is extruded with longitudinal grooves 21, and rows of teeth 23, formed upon a base 24, by extrusions and machining are slid into grooves 21. The base 25 is made a tight-fit in groove 21 such that the rows of teeth will normally remain in place without any securing devices, however it is understandable that grooves 21 could be made closed at one end and a cap, such as 11 in FIG. 1 and 17 in FIG. 2, could be used to close the open ends of grooves 21 and hold the rows of teeth securely in place.

In all embodiments, the same type of teeth have been shown, as this shape of tooth is an ideal shape for use when styling hair. Also if a tooth is too short, it is not effective, for styling, whereas if a tooth is too long it becomes caught in the hair. By having a rectangular section substantially flat tooth it is possible, for effectiveness, to utilize more teeth per unit length than when using a round or oval section tooth. The length of the tooth for effective styling should preferably be between $\frac{1}{4}''$ and $\frac{3}{8}''$ with the ideal length being 5/16".

Also, twelve rows of teeth are shown in the embodiments, although it is understandable that any suitable number of rows of teeth could be used, the number mainly depending upon manufacturing limitations.

We claim:

1. In a hair styling brush having a handle and a heating element, an improved attachment therefor consisting of an open ended tube of heat conducting material securable over the heating element, a plurality of rows of radially projecting heat conducting teeth extending from the outer surface of said tube, each tooth having a base with a substantially rectangular cross section, parallel transverse faces and longitudinal edges convergent towards an apex, the length of each tooth from its base to its apex being from $\frac{1}{4}''$ to $\frac{3}{8}''$, and a non-heat conducting cap secured to the end of said tube which is furthest from said handle to prevent inadvertent burning of the person using said brush, said teeth being disposed on that portion of said tube which is adjacent to said cap.

2. The brush of claim 1, wherein each tooth has a narrow edge ending in a rounded point.

3. The brush of claim 1, wherein each tooth has a length of 5/16".

4. The brush of claim 1, wherein each row of teeth is aligned with the longitudinal axis of the tube.

5. The brush of claim 1, wherein the teeth are integral with the tube.

6. The brush of claim 1, wherein the teeth are formed on a separate sleeve, the sleeve being a friction fit over the tube.

* * * * *